US006536389B1

(12) United States Patent
Shelby et al.

(10) Patent No.: US 6,536,389 B1
(45) Date of Patent: Mar. 25, 2003

(54) ADAPTIVE CONTROL OF CYLINDER VALVE TIMING IN INTERNAL COMBUSTION ENGINE

(75) Inventors: Michael Howard Shelby, Dearborn Hts., MI (US); Robert Albert Stein, Saline, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/063,363

(22) Filed: Apr. 16, 2002

(51) Int. Cl.[7] ..... F01L 13/00

(52) U.S. Cl. ..... 123/90.15; 123/90.17; 123/90.18

(58) Field of Search ..... 123/90.11, 90.12, 123/90.15, 90.16, 90.17, 90.18

(56) References Cited

U.S. PATENT DOCUMENTS 5,209,202 A 5/1993 Maurer et al. ..... 123/414
5,245,968 A 9/1993 Kolias et al. ..... 123/414
5,548,995 A 8/1996 Clinton et al. ..... 73/116
5,797,360 A * 8/1998 Pischinger et al. ..... 123/90.11
5,937,805 A * 8/1999 Matsumura ..... 123/90.15
6,101,993 A 8/2000 Lewis et al. ..... 123/90.17
6,397,803 B1 * 6/2002 Fujiwara et al. ..... 123/90.15
6,415,753 B1 * 7/2002 Nagaosa et al. ..... 123/90.18

* cited by examiner

*Primary Examiner*—Thomas Denion
*Assistant Examiner*—Kyle Riddle

(57) ABSTRACT

A system for controlling the timing of a cylinder valve in a reciprocating internal combustion engine includes a crankshaft position sensor for determining position of the crankshaft, and a camshaft structural force sensor for determining the presence of a structural force upon the camshaft related to a unique rotational position of the camshaft. A controller receives position signals from the crankshaft and camshaft structural force sensors. The controller compares the valve position signal from the structural force sensor with a predicted valve position based upon the crankshaft position and determines if the predictive value is in error. If an error is greater than a specified threshold, the predictive model will be corrected.

13 Claims, 5 Drawing Sheets

18
CAMSHAFT BEARING LOAD SENSOR
24
ENGINE CONTROLLER
20
22
CAMSHAFT TIMING OPERATOR
26

ADAPTIVE CONTROL OF CYLINDER VALVE TIMING IN INTERNAL COMBUSTION ENGINE

BACKGROUND OF INVENTION

The present invention relates to a system for controlling the timing of cylinder valves used in a reciprocating internal combustion engine. This system uses a very precise measure or indication of valve closing in combination with rotary position sensing of a camshaft or crankshaft.

With dual equal or dual independent operation of camshaft timing, the trapped air charge for a given intake manifold pressure is affected by the intake valve closing timing. For a V-type engine, differences in bank-to-bank cam timing will result in corresponding differences in air charge and indicated mean effective pressure (IMEP). Under conditions in which the camshaft timing is retarded significantly at part load, the negative effect on IMEP may cause significant noise, vibration, and harshness (NVH) if the bank-to-bank camshaft timing difference exceeds two crankshaft angle degrees. It has been found that the stack up of production level manufacturing and assembly tolerances may in certain cases exceed this limit. In one particular engine, the difference in bank-to-bank cam timing angle was expected to exceed twelve crankangle degrees. This variation would be expected to result in severe NVH problems.

A system and method according to present invention solves the problem of achieving precise control of camshaft timing by providing a marker which corresponds to the actual valve closing for at lease one valve for each bank of cylinders. This is achieved by measuring the structural load upon the camshaft, which provides a very clear and precise measurement of the valve spring force acting upon the camshaft, which is in itself an accurate indication of the actual valve position. This measurement may be employed in the control system feedback loop or as an adaptive update to current feedback systems which generally use signals from a trigger wheel and sensor. An alternative approach could be to employ a knock sensor to determine valve closing from the knock sensor output under conditions where closing could be reliably measured, such as during idle. The knock sensor measurement can be used for adaptively updating a trigger wheel or sensor system mounted on either a camshaft or the crankshaft.

SUMMARY OF INVENTION

A system for controlling the timing of a cylinder valve camshaft in a reciprocating internal combustion engine includes a camshaft structural force sensor for sensing structural force upon the camshaft, with said structural force being associated with a predetermined unique rotational position of the camshaft, and with the structural force sensor generating a camshaft event signal corresponding to said predetermined unique position. A camshaft timing sensor determines the rotational position of the camshaft and generates a rotary position signal corresponding to the rotational position of the camshaft. A controller receives the camshaft event signal and the rotary position signal. The controller comprises a comparator for comparing the position of the camshaft as indicated by the rotary position signal with the predetermined rotational position of the camshaft corresponding to the camshaft event signal. The controller may further comprise a corrector for correcting the rotary position signal based upon the results of the comparison. In one embodiment of the present invention, a camshaft structural force sensor may comprise a load washer associated with a bearing fastener of the camshaft. This load washer may, for example, comprise of piezoelectric force sensor mounted under a camshaft bearing fastener.

According to another aspect of the present invention, a controller receives a crankshaft position sensor position signal and a valve position signal. The controller comprises a predictor for predicting valve position based on the sensed position of the crankshaft, and a comparator for comparing at a predetermined crankshaft position, the actual poppet valve position as determined by the controller from the valve position signal, with the predicted valve position. The controller creates an error signal in the event that the difference between the actual poppet valve position and the predicted valve position exceeds a predetermined threshold.

According to yet another aspect of the present invention, a method for controlling the timing of a cylinder valve camshaft incorporated within a reciprocating internal combustion engine includes the steps of sensing the presence of a structural force upon the camshaft associated with a unique rotational position of the camshaft, reading the indicated rotational position of the camshaft by means of a camshaft position sensor when said structural force is sensed, comparing the unique rotational position of the camshaft, as evidenced by the presence of said structural force, with the indicated rotational position of the camshaft, and correcting the indicated rotational position of the camshaft in the event that the difference between the indicated camshaft position and the unique rotational position exceeds a predetermined threshold.

According to another aspect of the present invention, a system for controlling the timing of a poppet valve operating system in a reciprocating internal combustion engine includes a sensor for sensing a vibration associated with the closing of one or more poppet valves, and for generating a valve closing signal corresponding to the onset of said vibration. A timing sensor determines the rotational position of a rotating shaft that is in the engine and generates a rotary position signal corresponding to the rotational position of the shaft. Finally, a controller receives the valve closing signal and the rotary position signal and compares the value of the rotary position signal with the predetermined rotational position of the shaft corresponding to generation of the valve closing signal.

It is an advantage of the present invention that the "dead-reckoning" provided by conventional sensor wheels and pickups may be corrected by a very precise signal corresponding to the actual closing of a valve.

It is a further advantage of the present invention that a system according to this invention will allow more precise control of engine output torque and engine out feedgases.

It is a further advantage of the present invention that the system according to this invention will allow superior NVH performance of an engine.

Other advantages of the present invention as well as objects and features thereof will become apparent to the reader of this specification.

DETAILED DESCRIPTION

Figure 1:
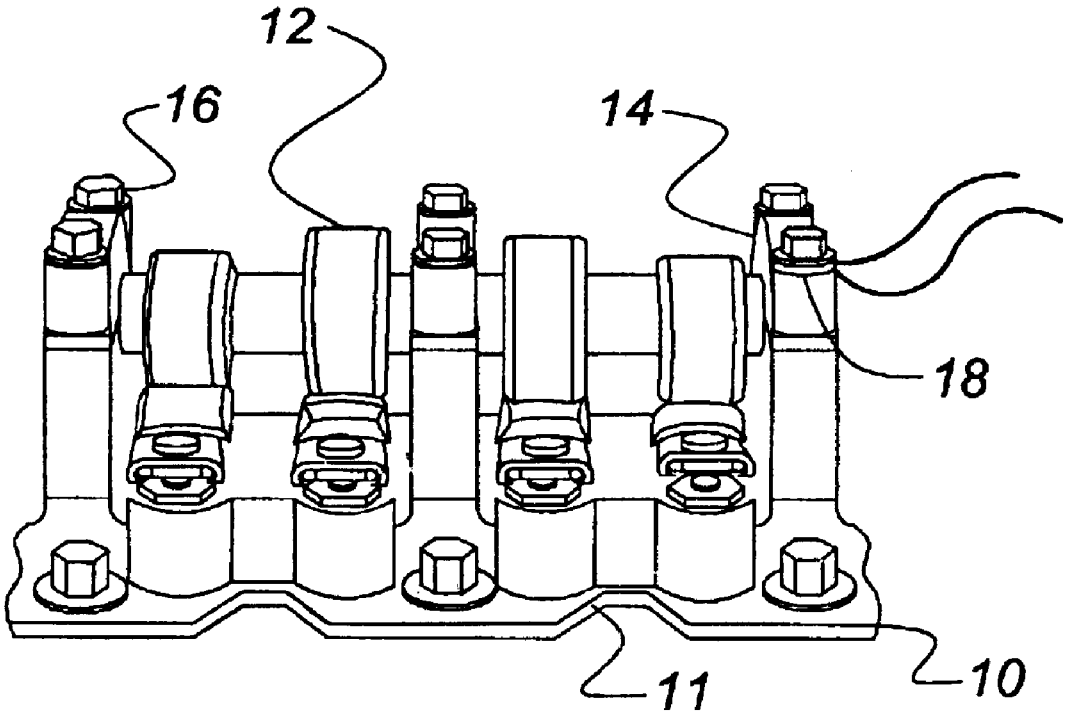
FIG. 1 is a perspective view of a cylinder head including a sensor according to the present invention.

As shown in FIG. 1, engine cylinder head 10 which includes casting 11 and camshafts 12, is intended to be mounted upon the cylinder block of an internal combustion engine. Camshafts 12 of FIG. 1 are shown as being retained by conventional bearing caps and bolts or cap screws, with at least one load washer (18) being interposed between one of camshaft caps (14) and the corresponding camshaft cap attaching bolt (16).

Figure 2:
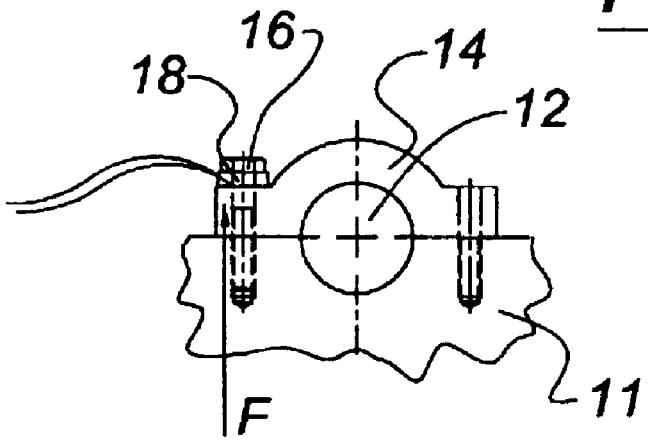
FIG. 2 is a cutaway view of a camshaft mounting arrangement including a camshaft structural force sensor according to the present invention.

FIG. 2 illustrates one embodiment of a fastening system according to the present invention. Thus, casting 11 is shown as providing a base for mounting of camshaft cap 14, with camshaft 12 being confined between casting 11 and camshaft cap 14. As is also shown in FIG. 2, cap screw 16 has load washer 18 mounted underneath the cap screw between the cap screw 16 and cap 14. FIG. 2 illustrates that the force acting upon camshaft caps 14, bolts 16 and load washer 18 are in a direction having a component which is parallel to the axis of bolt 16. In other words, when one of the cams on camshaft 12 opens a valve, an attending moment is placed upon the camshaft and this moment is counteracted by, and the camshaft is maintained in contact with casting 11 by means of caps 14. As a result, the stress upon bolt 16, as measured by load washer 18, is a direct indication of the position of the particular valve being opened or closed.

Figure 3:
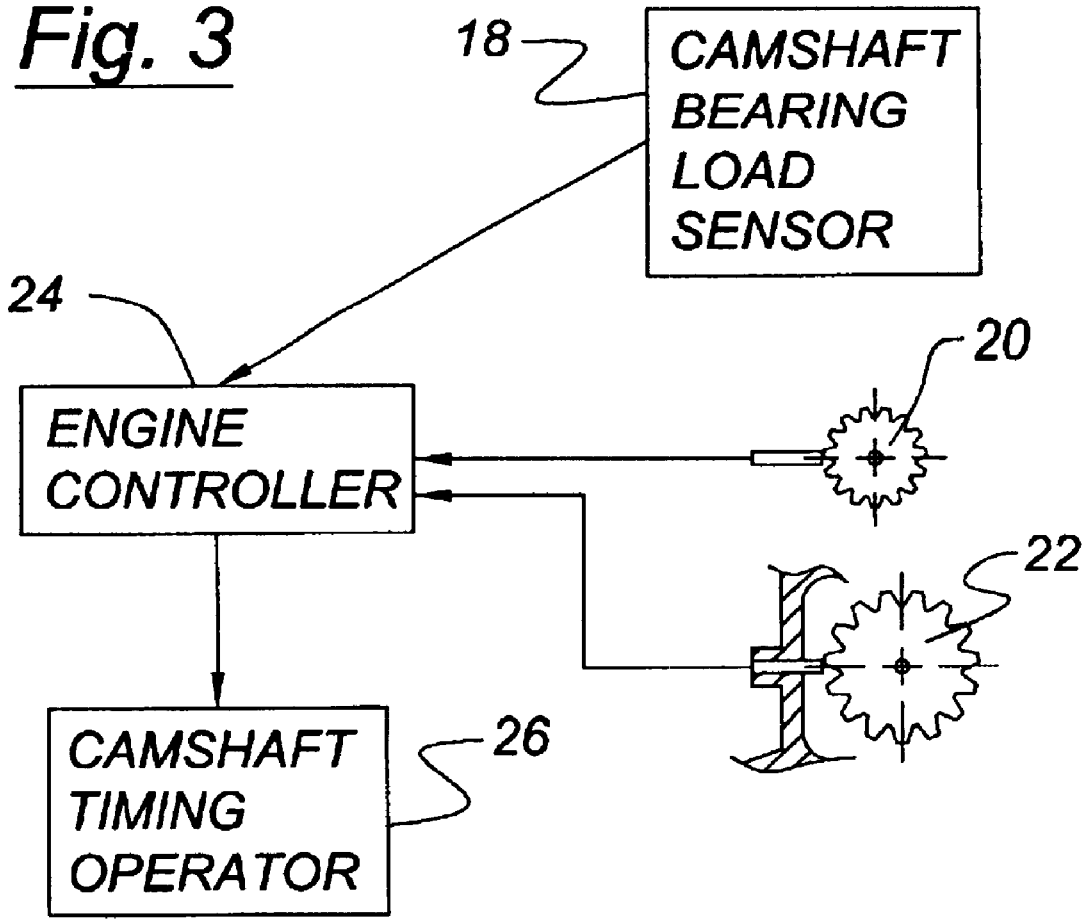
FIG. 3 illustrates components of a control system according to the present invention.

FIG. 3 illustrates a control system according to the present invention. Camshaft bearing load sensor shown at 18 is the sensor of FIGS. 1 and 2. Camshaft position sensor 20 is a conventional tooth-wheel and pickup assembly. Similarly, crankshaft position sensor 22 may comprise a toothed-wheel with sensor. The particular type of rotary position sensors used in a system according to the present invention will be dictated by the design needs of the particular engine in which the system is being built and this detail forms no part of the present invention. In any event, camshaft bearing load sensor 18, camshaft position sensor 20 and crankshaft position sensor 22 provide inputs to engine controller 24, which may be any of the commonly employed types of engine controllers or power train controllers known to those skilled in the art and suggested by this disclosure.

Engine controller 24 operates camshaft timing operator 26, which may be drawn from any one of the class of camshaft timing operators known to those skilled in the art and suggested by this disclosure. Such devices commonly employ hydraulic pressure to change the phasing of the camshaft with respect to the engine's crankshaft. Other types are known such as those which use camshaft torque reversals to change the phasing. A typical example of a camshaft timing operator is disclosed in U.S. Pat. No. 6,186,104. The point here is that camshaft timing control systems are known to operate with a certain error which a system according to the present invention allows to be corrected.

Figure 5:
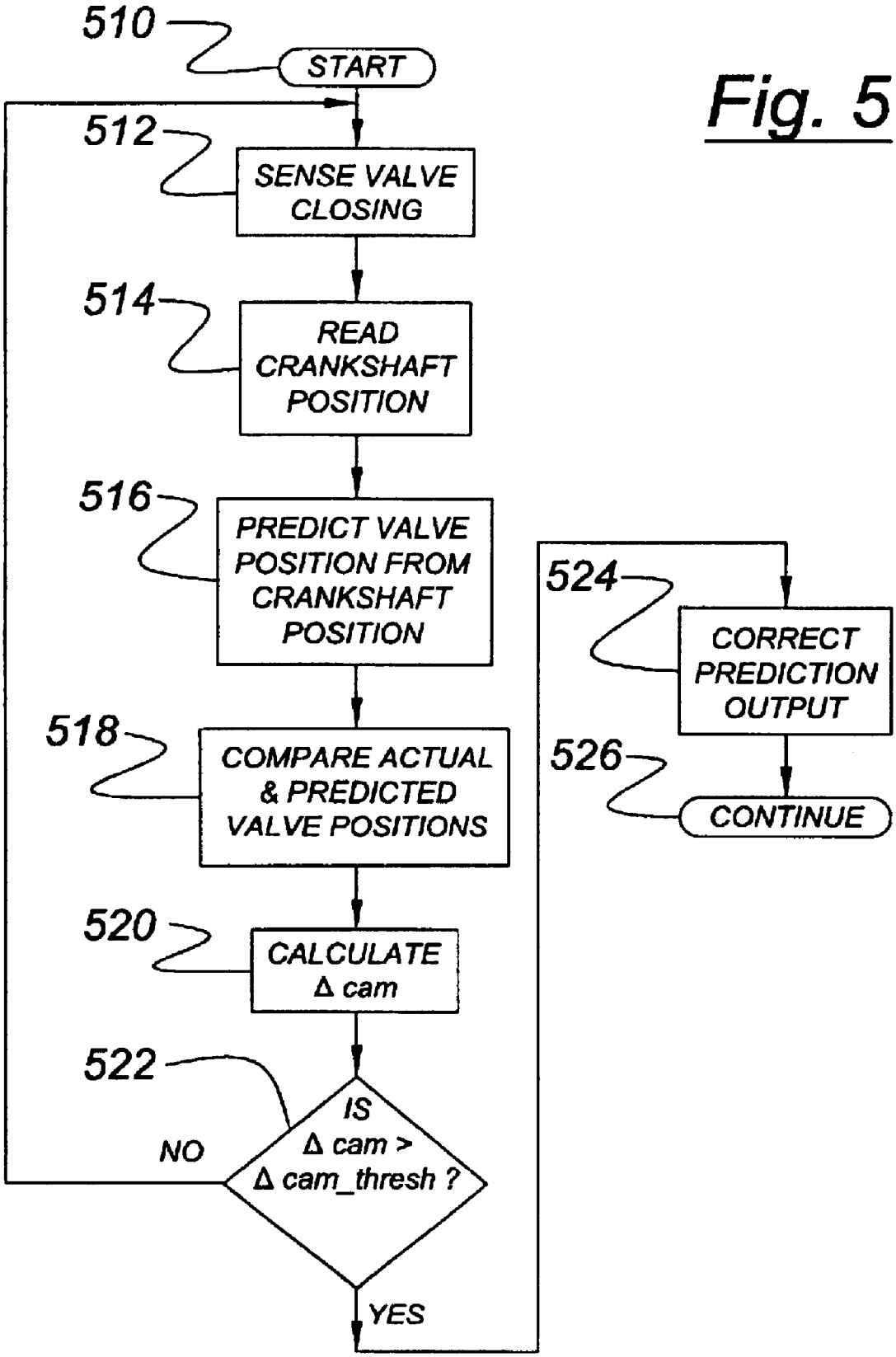
Figure 6:
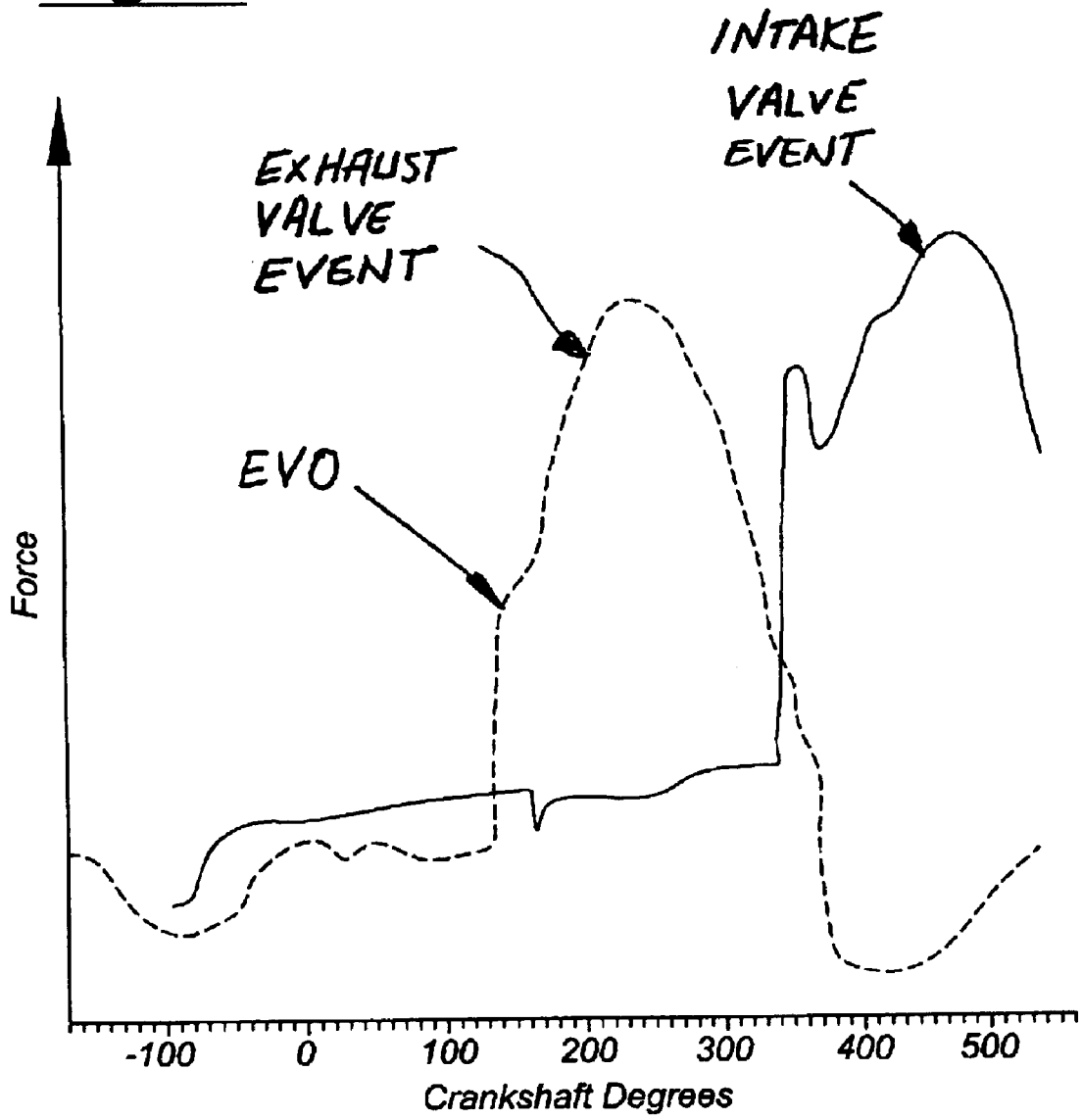
FIG. 6 illustrates camshaft structural force as sensed by a sensor according to the present invention.

FIG. 6 illustrates the waveform of the force sensed by camshaft bearing load sensor 18 as a function of crankshaft position. Of course, as noted above, this load is directly related to the valve's position, because the load arises from the valve springs, which have an almost linear spring constant. In the curve labeled Exhaust Valve Event, it is noted that at the position marked "EVO", the exhaust valve is opening, and the valve opening is accompanied by greater spring pressure, which in turn results in imposition of an increased structural force upon camshaft 12. This structural force increases steadily until a maximum is achieved at about 250 crankangle degrees, and then decreases to a minimum value at about 380 crankangle degrees when the exhaust valve closes. It is noted that a precipitous decline occurs in the sensed force at the time the exhaust valve closes. This sharp decline may be employed for the purpose of detecting by means of load washer (18) the precise time at which the exhaust or intake valve closes. This measurement is used as described in FIGS. 4 and 5 to provide increased control capability with respect to a valve operating system.

Figure 4:
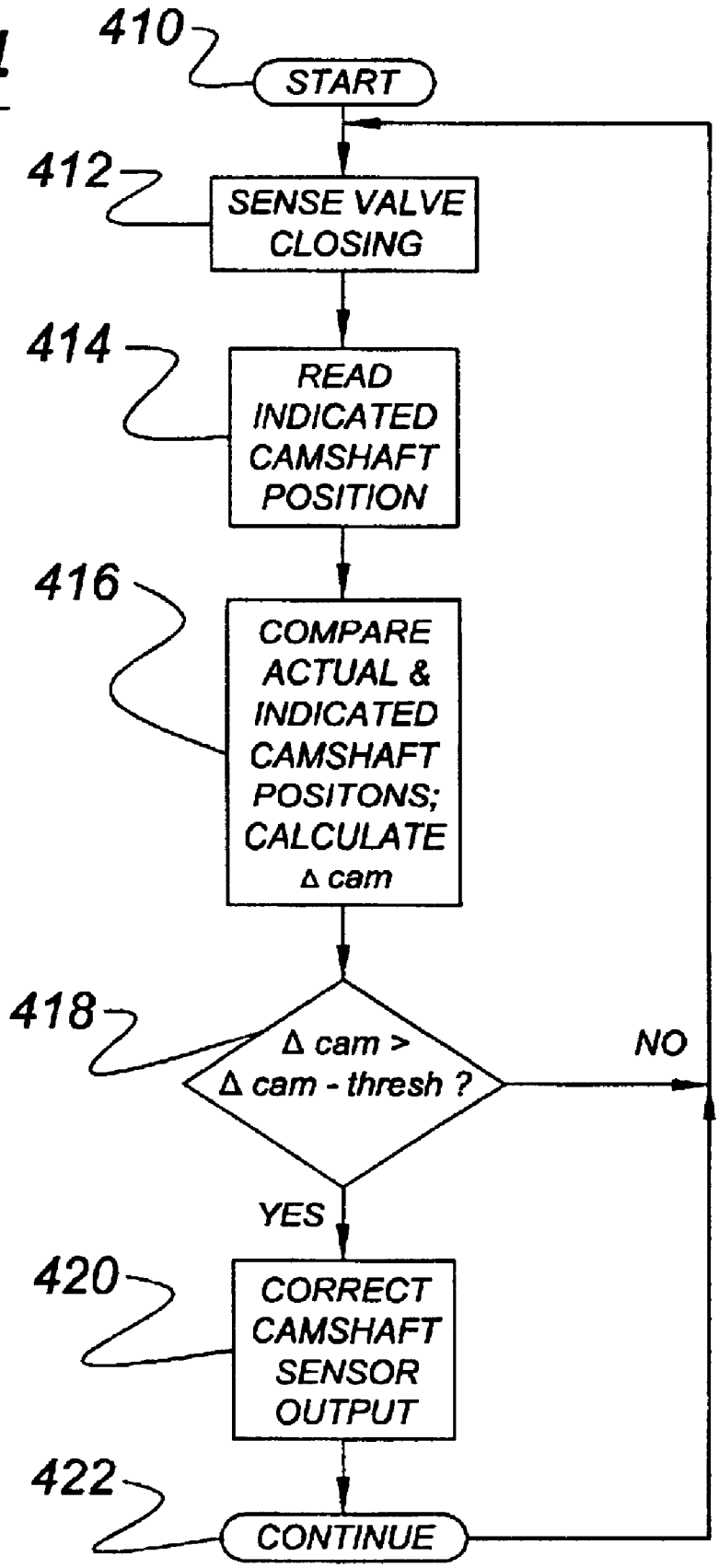
FIGS. 4 and 5 illustrate alternate embodiments of a control system flow chart according to the present invention.

According to FIG. 4, a routine according to present invention begins at start block 410 and moves to valve sensing at block 412. This position may be, for example, indicated in FIG. 6 at the position marked Exhaust Valve Closing, as sensed by load washer 18. As noted above, it is understood from FIG. 6 that the structural force on the camshaft drops dramatically when the exhaust valve closes and thus, the structural force marked EVC corresponds to a predetermined unique rotational position of the camshaft. After starting at block 410 the routine moves to block 412 wherein the valve closing is sensed by load washer 18, which of course feeds a corresponding signal to controller 24. When load washer 18 indicates that the valve is closed at block 412, the routine moves to block 414 wherein the indicated camshaft position is read by means of camshaft position sensor 20. Thereafter at block 416, the indicated and actual camshaft positions are compared. Note that the actual camshaft position is known because when the valve closes as is determined by camshaft bearing load sensor 18, this event occurs at a unique camshaft position. Also at block 416, Δ cam, which is the difference between the actual and indicated camshaft positions is calculated. Then the routine moves to block 418 wherein the question is asked "Is Δ cam greater than a Δ cam threshold value?" If this is not the case, the routine continues by looping at block 418. If the error is greater than the threshold value at block 418, the routine moves to block 420 wherein the camshaft sensor output is corrected. This is accomplished, for example, by placing an offset in a lookup table containing camshaft position as a function of the output of camshaft position sensor 20.

FIG. 5 illustrates another embodiment according to the present invention. Beginning at block 510, controller 24 moves to 512, wherein controller 24 waits for cylinder valve to close, which is of course sensed by means of camshaft bearing load sensor 18 as described above. When a valve is sensed as having closed at block 512, the routine moves to block 514 wherein crankshaft position is read by means of crankshaft position sensor 22, then at block 516, controller 24 predicts valve position from the sensed crankshaft position. This predicted valve position is compared at block 518 with actual valve position, which of course has been indicated as being closed, at block 512. Then at block 520, Δ cam as determined as the difference between the actual and predicted valve positions. Then at block 522, the magnitude of Δ cam is compared with the Δ cam threshold value and if the threshold is exceeded, the prediction output is corrected at block 524 and the routine continues at 526. If, however, delta cam is less than the threshold value, the routine continues again at 512. As before, the prediction can be corrected either by applying a linear correction factor to the predictive valve position value, or by correcting a lookup table. Such details are beyond the scope of this invention and are consigned to those skilled in the art wishing to implement a system according to the present invention.

As yet another embodiment according to the present invention, according to FIG. 5, valve closing may be sensed by means of a knock sensor when the engine is operating, for example at idle when knock is not anticipated. It has been determined by the inventor that a moderately sensitive knock sensor will be capable of detecting vibration arising from the closing of an intake or exhaust valve. As a result, a knock sensor may be used in the method and procedure of FIG. 5 to obtain a correction of the predicted valve position.

What is claimed is:

1. A system for controlling the timing of a cylinder valve camshaft in a reciprocating internal combustion engine, comprising:

a camshaft structural force sensor for sensing structural force upon the camshaft, with said structural force being associated with a predetermined unique rotational position of the camshaft, and with said structural force sensor generating a camshaft event signal corresponding to said predetermined unique position;

a camshaft timing sensor for determining the rotational position of the camshaft and for generating a rotary position signal corresponding to the rotational position of the camshaft; and a controller for receiving said camshaft event signal and said rotary position signal, with said controller comprising a comparator for comparing the position of the camshaft, as indicated by the rotary position signal, with the predetermined rotational position of the camshaft corresponding to the camshaft event signal.

2. A system according to claim 1, with said controller further comprising a corrector for correcting the rotary position signal, based upon the results of said comparison.

3. A system according to claim 1, wherein said camshaft structural force sensor comprises a load washer associated with a bearing fastener of said camshaft.

4. A system according to claim 3, wherein said load washer comprises a piezoelectric force sensor mounted under a camshaft bearing fastener.

5. A system according to claim 1, wherein said predetermined unique position comprises the rotational position at which a valve operated by the camshaft comes to a fully closed position.

6. A system for controlling the timing of a cylinder valve operating system in a reciprocating internal combustion engine, comprising:

a crankshaft position sensor for determining the position of the crankshaft and for generating a crankshaft position signal corresponding to the crankshaft's position;

a camshaft structural force sensor for determining the presence of a structural force upon the camshaft, with said structural force being associated with the operational position of one or more poppet valves operated by the camshaft, with said structural force sensor generating a valve position signal corresponding to the position of said one or more poppet valves; and a controller for receiving said crankshaft position signal and said valve position signal, with said controller comprising a predictor for predicting valve position based upon the sensed position of the crankshaft, and a comparator for comparing, at predetermined crankshaft position, the actual poppet valve position, as determined by the controller from the valve position signal, with said predicted valve position, with said controller creating an error signal in the event that the difference between the actual poppet valve position and the predicted valve position exceeds a predetermined threshold.

7. A system according to claim 6, wherein said camshaft structural force sensor comprises a load washer associated with a bearing fastener of said camshaft.

8. A system according to claim 7, wherein said load washer comprises a piezoelectric force sensor mounted under a camshaft bearing fastener.

9. A method for controlling the timing of a cylinder valve camshaft incorporated within a reciprocating internal combustion engine, comprising the steps of:

sensing the presence of a structural force upon the camshaft associated with a unique rotational position of the camshaft;

reading the indicated rotational position of the camshaft by means of a camshaft position sensor when said structural force is sensed;

comparing the unique rotational position of the camshaft, as evidenced by the presence of said structural force, with the indicated rotational position of the camshaft; and correcting the indicated rotational position of the camshaft in the event that the difference between the indicated camshaft position and the unique rotational position exceeds a predetermined threshold.

10. A system for controlling the timing of a poppet valve operating system in a reciprocating internal combustion engine, comprising:

a sensor for sensing a vibration associated with the closing of one or more poppet valves and for generating a valve closing signal corresponding to the onset of said vibration;

a timing sensor for determining the rotational position of a rotating shaft within the engine, and for generating a rotary position signal corresponding to the rotational position of the shaft; and a controller for receiving said valve closing signal and said rotary position signal, with said controller comprising a comparator for comparing the value of the rotary position signal with the predetermined rotational position of the shaft corresponding to generation of the valve closing signal.

11. A system according to claim 10, wherein said sensor for sensing a vibration comprises an engine knock sensor.

12. A system according to claim 10, wherein said rotating shaft comprises the engine's crankshaft.

13. A system according to claim 10, wherein said rotating shaft comprises a camshaft for operating cylinder poppet valves.

* * * * *